US009788626B2

(12) United States Patent
Pedroarena

(10) Patent No.: US 9,788,626 B2
(45) Date of Patent: Oct. 17, 2017

(54) CORDLESS HAIRSTYLING TOOLS WITH RECHARGEABLE AND INTERCHANGEABLE BATTERIES

(71) Applicant: Christopher Lee Pedroarena, Newport Beach, CA (US)

(72) Inventor: Christopher Lee Pedroarena, Newport Beach, CA (US)

( * ) Notice: Subject to any disclaimer, the term of this patent is extended or adjusted under 35 U.S.C. 154(b) by 0 days.

(21) Appl. No.: 15/298,226

(22) Filed: Oct. 20, 2016

(65) Prior Publication Data

US 2017/0035174 A1 Feb. 9, 2017

Related U.S. Application Data

(63) Continuation of application No. 14/618,921, filed on Feb. 10, 2015, now Pat. No. 9,474,347.

(60) Provisional application No. 61/938,171, filed on Feb. 11, 2014.

(51) Int. Cl.

| | |
|---|---|
| ***A45D 1/04*** | (2006.01) |
| ***A45D 20/12*** | (2006.01) |
| ***A45D 2/00*** | (2006.01) |
| *A45D 1/00* | (2006.01) |

(52) U.S. Cl.

CPC ..... *A45D 1/04* (2013.01); *A45D 2/001* (2013.01); *A45D 20/12* (2013.01); *A45D 2001/002* (2013.01); *A45D 2001/045* (2013.01)

(58) Field of Classification Search

CPC ..... A45D 1/04; A45D 2/001; A45D 20/12; A45D 2001/002; A45D 2001/045

USPC ..... 34/97

See application file for complete search history.

(56) References Cited

U.S. PATENT DOCUMENTS

| | | | | | |
|---|---|---|---|---|---|
| 4,757,183 | A * | 7/1988 | Karey | A45D 20/10 | 219/543 |
| 4,857,702 | A * | 8/1989 | Cafaro | A45D 1/04 | 132/232 |
| 5,124,532 | A * | 6/1992 | Hafey | A45D 1/00 | 132/229 |
| 5,394,620 | A * | 3/1995 | Chimera | A45D 20/10 | 34/97 |
| D369,434 | S * | 4/1996 | LeCompte, Sr. | D28/13 | |
| 6,449,870 | B1 * | 9/2002 | Perez | A45D 20/12 | 34/96 |
| 7,119,304 | B2 * | 10/2006 | Meyers | A63C 11/222 | 124/86 |
| 7,380,347 | B2 * | 6/2008 | Coats | A45D 20/12 | 34/97 |
| 7,481,228 | B2 * | 1/2009 | Ragosta | A45D 1/04 | 132/238 |

(Continued)

FOREIGN PATENT DOCUMENTS

| | | | | |
|---|---|---|---|---|
| EP | 0 401 441 | * | 12/1990 | |
| EP | 1190681 | A2 * | 3/2002 | A61C 5/62 |
| WO | WO 2015112591 | A1 * | 7/2015 | A47J 39/00 |

*Primary Examiner* — Stephen M Gravini

(74) *Attorney, Agent, or Firm* — Lapple Ubell IP Law, LLP; Matthew C. Lapple

(57) ABSTRACT

A suite of cordless hairstyling devices with interchangeable, rechargeable batteries is provided. The suite includes a cordless blow dryer, a cordless curling iron, a cordless flat iron, a plurality of rechargeable, interchangeable battery packs and a recharging station. The suite of hairstyling devices each have a handle with an indentation which is configured to receive one of the rechargeable, interchangeable battery packs.

18 Claims, 2 Drawing Sheets

(56) References Cited

U.S. PATENT DOCUMENTS

| | | | | |
|---|---|---|---|---|
| 8,146,264 | B1 * | 4/2012 | Stefano | A45D 20/12 34/96 |
| 9,326,578 | B2 * | 5/2016 | Yoshidome | A45D 20/12 |
| 9,474,347 | B2 * | 10/2016 | Pedroarena | A45D 20/12 |
| 9,526,311 | B1 * | 12/2016 | Schaefer | A45D 20/08 |
| 9,599,367 | B1 * | 3/2017 | Curry | |
| 2008/0135537 | A1 * | 6/2008 | Suber | A45D 1/04 219/225 |
| 2008/0216339 | A1 * | 9/2008 | Gray | A45D 20/10 34/97 |
| 2012/0125909 | A1 * | 5/2012 | Scheunert | A45D 20/12 219/222 |
| 2013/0056017 | A1 * | 3/2013 | Rigsby | A45D 20/12 132/271 |
| 2014/0325880 | A1 * | 11/2014 | Shamji | B60S 3/002 37/230 |
| 2017/0035174 | A1 * | 2/2017 | Pedroarena | A45D 20/12 |

* cited by examiner

CORDLESS HAIRSTYLING TOOLS WITH RECHARGEABLE AND INTERCHANGEABLE BATTERIES

CROSS REFERENCE TO RELATED APPLICATIONS

The present application is a continuation, and claims the benefit of, and priority to, U.S. patent application Ser. No. 14/618,921, also entitled, "Cordless Hairstyling Tools with Rechargeable and Interchangeable Batteries," filed on Feb. 10, 2015, and issued on Oct. 25, 2016 as U.S. Pat. No. 9,474,347, and also claims priority to U.S. Provisional Patent Application Ser. No. 61/938,171, which was filed on Feb. 11, 2014. The subject matter of both U.S. patent application Ser. No. 14/618,921 and U.S. Provisional Patent Application Ser. No. 61/938,171 is hereby incorporated by reference as if written in their entirety herein.

BACKGROUND

Field of the Invention

The present invention relates generally to a suite of cordless hair styling devices that are each powered by an interchangeable, rechargeable battery pack that can be used by all devices in the suite. Specifically, embodiments of the invention disclose a cordless blow dryer, a cordless curling iron, a cordless flat iron, an interchangeable and rechargeable battery pack that can be used by any of the disclosed cordless hair styling devices, and a recharging station for recharging expended battery packs.

Description of Related Art

Professional hair stylists in a salon environment, as well as home users, struggle with the hassle, inconvenience and safety issue of tangled and cluttered electric cords necessary for electric hair styling devices such as blow dryers, curling irons and flat irons. During use, cords inevitably become tangled during use and must be detangled, which often involves unplugging the cords, untangling them, and then re-plugging them into electrical outlets. Another problem encountered is the issue of accidently striking salon clients in the head or face with electric cords as the professional stylist does his or her work. Electric cords on hair styling products also present a tripping hazard, for both salon employees and customers. Moreover, hair styling devices that require electric cords lack portability in two ways. First, they cannot be used in locations that lack electrical outlets. Second, they can only be used in an area that is covered by the extent to which the electric cord will stretch from an electrical outlet.

Various attempts have been made to solve these problems with various designs of cordless hairstyling devices using batteries, without commercial success or widespread adoption. Each has various drawbacks and weaknesses, including, without limitation, that the batteries are difficult or slow to recharge, that the batteries are inconvenient or difficult to connect to the hairstyling device, that the batteries are bulky, heavy and cumbersome, and that the batteries are device specific and are not able to be used with other electric hairstyling devices.

Thus, there is a need to have a suite of cordless hairstyling devices that are adapted to use the same design of rechargeable, interchangeable battery pack, thereby solving these and other problems.

SUMMARY OF THE INVENTION

The present invention addresses and alleviates these problems with the prior art. While various embodiments of the suite of cordless hair styling devices of the present invention exist, each generally includes a cordless hairstyling device with a battery pack-receiving indentation in the handle for receiving a rechargeable, interchangeable battery pack. Further, embodiments of the invention include a cordless blow dryer, a cordless curling iron and a cordless flat iron, one or more a rechargeable battery packs that fit all three devices, and a recharging station.

The accomplishment of the above may be embodied in the form illustrated in the accompanying drawings and as set forth below in the detailed description of the embodiments. Attention is called to the fact that the drawings are illustrative only. Variations are contemplated as being part of the present invention, limited only by the scope of the claims.

DETAILED DESCRIPTION OF THE PREFERRED EMBODIMENTS

As shown in FIGS. 1-5, embodiments of the present invention comprise a suite of cordless hair styling devices, including but not limited to a blow dryer, a curling iron and a flat iron, each of which is powered by an interchangeable, rechargeable battery pack that can be used with each of the devices in the suite of cordless hair styling devices. Use of the interchangeable battery packs to power each of hair styling devices in the suite of devices obviates the need for power cords attached to each device, resulting in the advantages discussed above. Moreover, the interchangeability of the battery packs between and among the hairstyling devices of the suite enhances ease of use, rapid battery pack changes when the charge in a battery pack is expended, and the ability to always have one or more a fresh battery packs charged and ready for use.

Figure 1:
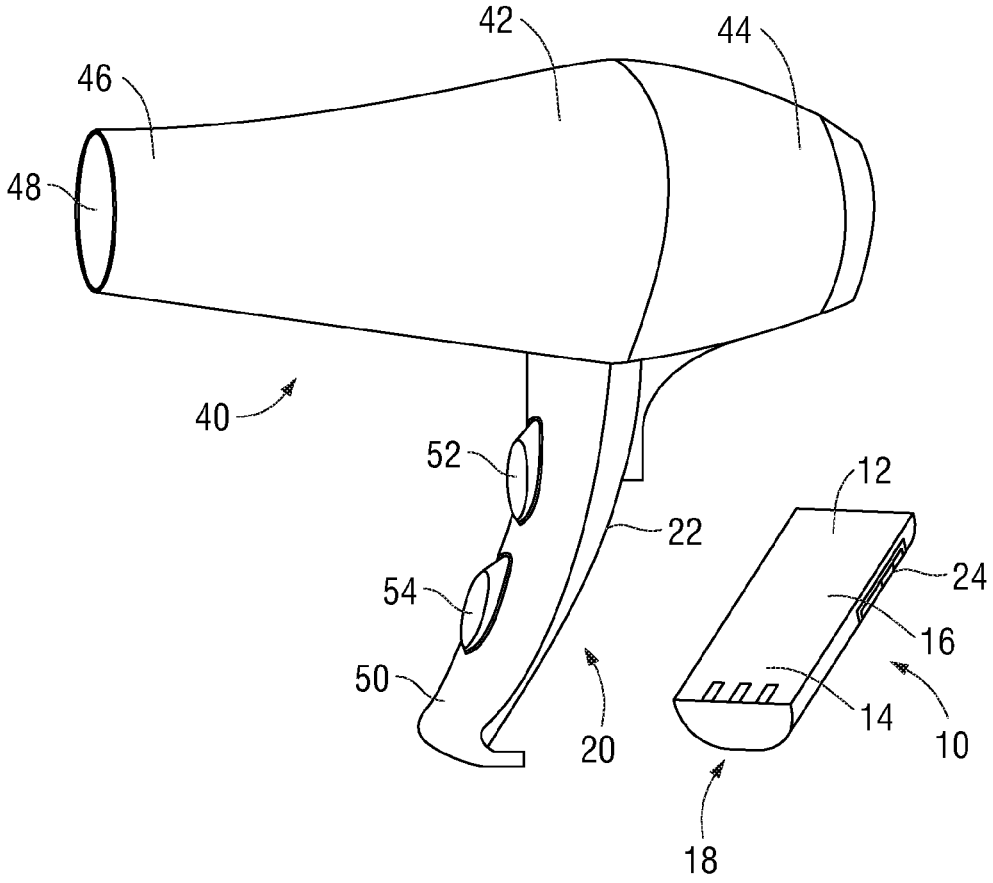
FIG. 1 is a perspective view of a cordless blow dryer in accordance with an embodiment of the present invention.
Figure 2:
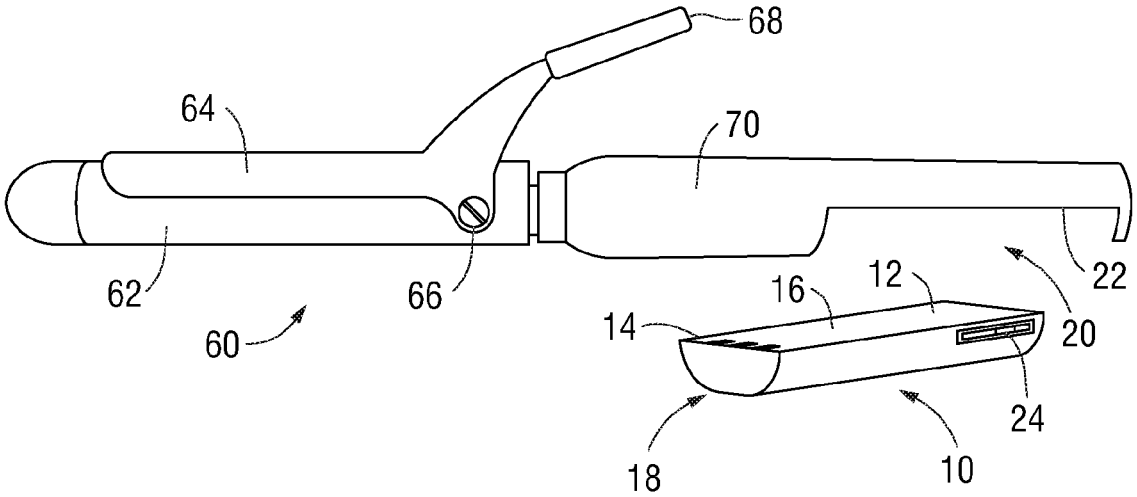
FIG. 2 is a perspective view of a cordless curling iron in accordance with an embodiment of the present invention.
Figure 3:
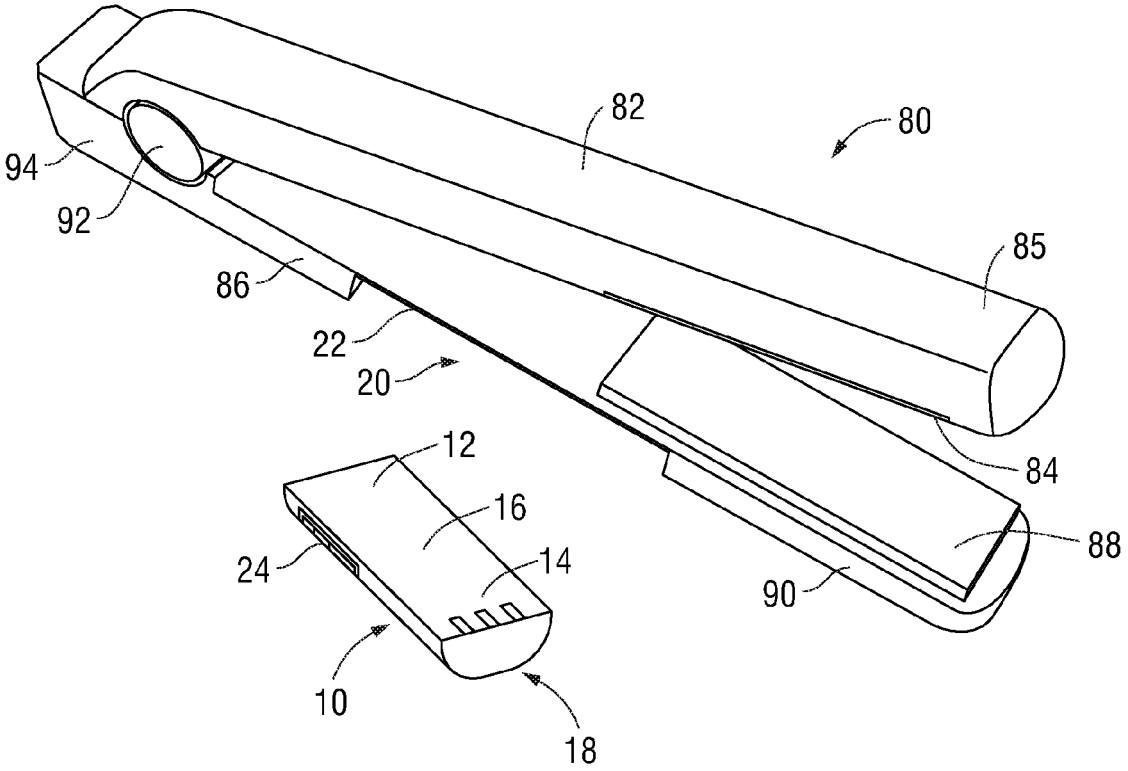
FIG. 3 is a perspective view of a cordless flat iron in accordance with an embodiment of the present invention.

Preferably, each battery pack 10 has a battery housing 12 made of durable plastic, and containing one or more rechargeable batteries. The one or more rechargeable batteries are preferably lithium ion batteries, but can be any suitable type of rechargeable battery. Each battery housing has a set of electrical contacts 14. Preferably, the battery housing is approximately 2.5 inches wide and 5 inches long. The battery housing has two opposite faces, namely an inner face 16 and an outer face 18. The inner face 16 is generally flat and rectangular in shape. The outer face is generally curved 18. As shown in FIGS. 1-3 and as further explained below, the shape of the battery pack 10 generally corresponds to a battery pack-receiving indentation 20 in the handle or arm of each of the hair styling devices in the suite of devices. The generally flat inner face 16 of the housing 12 of the battery pack 10 is shaped to match the inside face 22 of the battery-pack receiving indentation 20 in the handle or arm of each of the hair styling devices in the suite of devices. It will be understood that the inside face 22 need not be perfectly flat and may be contoured or shaped as is convenient, so long as the contours of the inner face 16 of the battery housing 12 generally correspond to and mirror the inner face 22 of the indentation 20. The curved outer face 18 of the battery housing 12 is shaped to generally conform to and match the curve of the various handles of the devices in the suite, such that the battery pack 10, when secured in place for use with a device, serves to provide a portion of a comfortable grip for the particular device in which it is secured. The battery pack 10 may be secured into the indentation 22 by generally known means such as clips, snaps or hooks. The battery pack housing 12 also preferably has a visible indicator 24 of the amount of charge present in the one or more rechargeable batteries. The visible indicator 24 may be an LED, a light, a digital readout, or other known means. In a further preferable embodiment, the visible indicator is a set of LED's in green, yellow and red, corresponding to full charge, weakening charge and replace, respectively.

Figure 4:
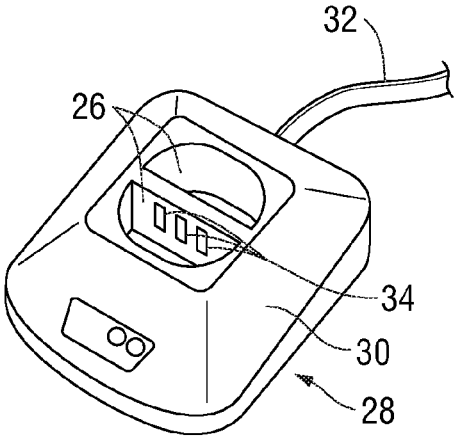
FIG. 4 is a perspective view of a battery pack recharging station in accordance with an embodiment of the present invention.
Figure 5:
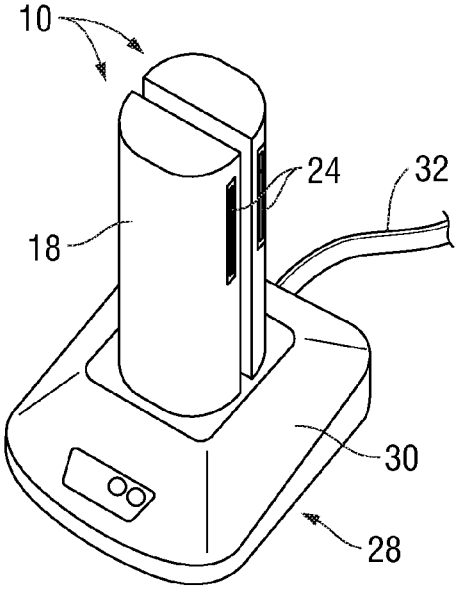
FIG. 5 is a perspective view of a battery pack recharging station, with at least one battery pack inserted for recharging, in accordance with an embodiment of the present invention.

Each battery pack 10 is also shaped to fit in a charging slot 26 of the battery pack recharging station 28, as shown in FIGS. 4 and 5. The battery pack recharging station 28 has a housing 30, a power cord 32 for plugging the recharging station 28 into an electrical outlet, with the housing 30 having a plurality of charging slots 26. In the embodiment shown, the recharging station 28 has two charging slots, 26 but additional charging slots may be provided, up to as many battery packs as may be charged given the current and voltage available from the electric power outlet. Each of the plurality of charging slots 26 has a set of electrical contacts 34 that are operably connected to transmit power from an electrical outlet (not shown) through the power cord 32 and into a battery pack 10 when it is in a charging slot 26. Each of said plurality of charging slots 26 is shaped to receive and secure a battery pack 10 such that when the battery pack 10 is placed in the charging slot, 26 the electrical contacts 14 of the battery pack 10 are in contact with the electrical contacts 34 of the charging slot 26 and the one or more rechargeable batteries of the battery back will be recharged. In the embodiment show, the recharging station 28 is approximately three inches on a side.

An embodiment of the cordless blow dryer of the suite of cordless hair styling products is illustrated in FIG. 1. The cordless blow dryer 40 has a housing 42 having an air intake end 44 and a cone-shaped air nozzle 46 that tapers toward an air outlet 48 distal from said air intake end 44. The cordless blow dryer 40 further has a blower fan and a heater element supported in said housing 42. The cordless blow dryer 40 has a handle 50 with an indentation 20 of substantially the same size as the battery housing 12 of the battery pack 10. The battery housing 12 may be inserted into the indentation 20 and secured in place, such that when the battery housing 12 is secured in place, the substantially flat rectangular inner face 16 of the battery housing 12 contacts an inner surface 22 of the indentation 20 and the substantially curved outer face 18 of the battery housing 12 aligns with the edges and curvature of the indentation 20 to form an ergonomically comfortable grip of the handle 50. In the indentation, 20 there are electrical contacts operably connected to the blower fan and the heater element, so that when the battery housing 12 is secured in place, the electric contact points 14 of the battery housing 12 are electrically connected to the electrical contacts of the indentation, 20 thereby allowing current to flow from the one or more rechargeable batteries to provide power to the blower fan and heater element.

Preferably, the blow dryer 40 has a handle 50 of between approximately 5 and 6 inches, and will have a length of approximately 6 to 8 inches, with a width at the wide end of 10-12 inches. Preferably, the blow dryer 40 also has a plastic fan blade and a metal screen on the air intake end 44 to prevent intake of foreign objects and loose hair. The blow dryer 40 also has a power switch 52 and a heat control switch 54 on the handle 50.

An embodiment of the cordless curling iron 60 of the suite of cordless hair styling products is illustrated in FIG. 2. The cordless curling iron 60 has an elongated curling mandrel, 62 a heating element (not shown) affixed inside and operably connected to the curling mandrel, 62 a spring-loaded clamp 64 attached to the mandrel 62 at a pivot point 66. The spring-loaded clamp 64 has a curvature substantially the same as the curvature of the curling mandrel 62, so that the clamp and the curling mandrel can generally fit together to clamp hair into a curve to create a curl when heat is applied. The spring-loaded clamp 64 has a lever arm 68 extending outwardly and rearwardly from the pivot point 66. When the end of the lever arm 68 is pressed, by for example, a user's thumb, it will cause the spring-loaded clamp 64 to pivot away from the curling mandrel 62 to allow the user to insert hair for curling. The curling iron has a handle 70 extending from the curling mandrel 62. The handle 70 has an indentation 20 of substantially the same size as the battery housing 12 of one of the rechargeable battery packs 10 described above. The battery housing 12 may be inserted into the indentation 20 and secured in place, such that when the battery housing 12 is secured in place, the substantially flat rectangular inner face 16 of the battery housing 12 contacts an inner surface 22 of the indentation 20 and the substantially curved outer face 18 of the battery housing 12 aligns with the edges and curvature of the indentation to form an ergonomically comfortable grip of the handle 70. In the indentation 20, there are electrical contacts operably connected to the heating element, so that when the battery housing 12 is secured in place, the electric contact points 14 of the battery housing 12 are electrically connected to the electrical contacts of the indentation 20, thereby allowing current to flow from the one or more rechargeable batteries to provide power to the heating element.

In a preferred embodiment, the cordless curling iron 60 is approximately 10 inches long and the width of the curling mandrel 62 is between 0.5 and 1.0 inches. Further preferably, the heating element of the cordless curling iron 60 can heat the curling mandrel 62 up to a temperature of at least 450 degrees Fahrenheit.

An embodiment of the cordless flat iron 80 of the suite of cordless hair styling products is illustrated in FIG. 3. The cordless flat iron 80 has a top elongated arm 82 with a first heating element (not shown) affixed inside the top elongated arm 82 and a first heating plate 84 at the distal end 86 of the top elongated arm 82. The first heating element is operably attached to said first heating plate 84. The cordless flat iron 80 also has a bottom elongated arm 86 with a second heating element (not shown) affixed inside the bottom elongated arm 86 and a second heating plate 88 at the distal end 90 of the bottom elongated arm 86. The second heating element is operably attached to said second heating plate 88. The top elongated arm 82 and the bottom elongated arm 86 are attached to one another at a pivot point 92 at the proximal ends 94 of the elongated arms. Preferably, a spring is operably affixed between the top elongated arm 82 and the bottom elongated arm 86 substantially at the pivot point 92. The spring is biased to maintain the top elongated arm 82 and bottom elongated arm 86 in an open position as shown in the FIG. 3. When in use, a user squeezes the arms together, with one or more locks of hair between the arms, thereby bringing the first and second plates into proximity with one another, and directing heat into the one or more locks of hair that are held between the plates, resulting in a straightening of and curls in the locks of hair.

The bottom elongated arm 86 has an indentation 20 of substantially the same size as the battery housing 12 of one of the rechargeable battery packs 10 described above. The battery housing 12 may be inserted into the indentation 20 and secured in place, such that when the battery housing 12 is secured in place, the substantially flat rectangular inner face 16 of the battery housing 12 contacts an inner surface 22 of the indentation 22 and the substantially curved outer face 18 of the battery housing 12 aligns with the edges and curvature of the indentation 20 to form an ergonomically comfortable grip on the bottom elongated arm 86. In the indentation 20, there are electrical contacts operably connected to the first and second heating elements, so that when the battery housing 12 is secured in place, the electric contact points 14 of the battery housing 12 are electrically connected to the electrical contacts of the indentation 20, thereby allowing current to flow from the one or more rechargeable batteries to provide power to the first and second heating elements, and in turn, to heat the first and second plates of the flat iron.

In a preferred embodiment, the flat iron 80 is approximately 10 inches long; and its width is between 0.5 and 1.0 inches. Further preferably, the first and second plates 84, 88 of the flat iron 80 are ceramic and can heat up to at least 450 degrees Fahrenheit.

The hair styling devices and recharging station may be fabricated from plastic, metal, and rubber. It will be understood that the devices may be of various sizes, including regular sizes and travel sizes. It will be further appreciated that the sizes described above are by way of example and illustration only, and are not intended to be limiting.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

What is claimed is:

1. A cordless hair dryer device comprising:
a housing;
an electric fan supported in said housing;
an electric heater supported in said housing;
said housing further comprising a handle;
a removable battery housing containing one or more rechargeable batteries;
said battery housing further comprising an outer face and a set of electric contact points operably connected to the one or more rechargeable batteries;
said handle further comprising an indentation of substantially the same size as the battery housing, said indentation further comprising electrical contacts operably connected to the electric fan and the electric heater element;
wherein the battery housing may be inserted into the indentation and secured in place, such that when the battery housing is secured in place, the outer face of the battery housing generally aligns with the edges of the indentation to form a curved outer face of the handle, and
wherein, when the battery housing is secured in place, the electric contact points of the battery housing are electrically connected to the electrical contacts of the indentation, thereby allowing current to flow from the one or more rechargeable batteries to provide power to the electric fan and the electric heater element.

2. The cordless hair dryer device of claim 1 wherein the battery housing further comprises a visible power meter to indicate the amount of charge remaining in the one or more rechargeable batteries.

3. The cordless hair dryer device of claim 1 wherein the one or more rechargeable batteries are lithium ion batteries.

4. The cordless hair dryer device of claim 1 wherein the battery housing has a length of about five inches and a width of about two and a half inches.

5. The cordless hair dryer device of claim 1 further comprising a battery recharging station comprising:
a housing;
a power cord for plugging the recharging station into an electrical outlet;
said housing further comprising a charging slot;
said charging slot comprising a set of electrical contacts that are operably connected to transmit power from the electrical outlet through the power cord;
wherein said charging slot further comprises a slot shaped to receive and secure the battery housing such that when the battery housing is secured in the charging slot, the electrical contacts of the battery housing are in contact with the electrical contacts of the charging slot such that the one or more rechargeable batteries of the battery housing can be recharged.

6. A cordless curling iron device comprising:
an elongated curling mandrel;
a heating element operably connected to the curling mandrel;
a handle extending from said curling mandrel;
a removable battery housing containing one or more rechargeable batteries;
said battery housing further comprising an outer face and a set of electric contact points operably connected to the one or more rechargeable batteries;
said handle further comprising an indentation of substantially the same size as the battery housing, said indentation further comprising electrical contacts operably connected to the heating element;
wherein the battery housing may be inserted into the indentation and secured in place, such that when the battery housing is secured in place, the outer face of the battery housing generally aligns with the edges and curvature of the indentation to form a curved outer face of the handle, and
wherein, when the battery housing is secured in place, the electric contact points of the battery housing are electrically connected to the electrical contacts of the indentation, thereby allowing current to flow from the one or more rechargeable batteries to provide power to the heating element.

7. The cordless curling iron device of claim 6 wherein the battery housing further comprises a visible power meter to indicate the amount of charge remaining in the one or more rechargeable batteries.

8. The cordless curling iron device of claim 6 wherein the one or more rechargeable batteries are lithium ion batteries.

9. The cordless curling iron device of claim 6 wherein the battery housing has a length of about five inches and a width of about two and a half inches.

10. The cordless curling iron device of claim 6 further comprising a battery recharging station comprising:

a housing;

a power cord for plugging the recharging station into an electrical outlet;

said housing further comprising a charging slot;

said charging slot comprising a set of electrical contacts that are operably connected to transmit power from the electrical outlet through the power cord;

wherein said charging slot further comprises a slot shaped to receive and secure the battery housing such that when the battery housing is secured in the charging slot, the electrical contacts of the battery housing are in contact with the electrical contacts of the charging slot such that the one or more rechargeable batteries of the battery housing can be recharged.

11. A cordless flat iron device comprising:

a first elongated arm;

a second elongated arm comprising a heating element;

wherein said first elongated arm and said second elongated arm are attached at a pivot point;

a removable battery housing containing one or more rechargeable batteries;

said battery housing further comprising an outer face and a set of electric contact points operably connected to the one or more rechargeable batteries;

said second elongated arm further comprising an indentation of substantially the same size as the battery housing, said indentation further comprising electrical contacts operably connected to the heating element;

wherein the battery housing may be inserted into the indentation and secured in place, such that when the battery housing is secured in place, the outer face of the battery housing generally aligns with the edges and curvature of the indentation to form a curved outer face on the second elongated arm, and wherein when the battery housing is secured in place, the electric contact points of the battery housing are electrically connected to the electrical contacts of the indentation, thereby allowing current to flow from the one or more rechargeable batteries to provide power to the heating element.

12. The cordless flat iron device of claim 11 wherein the battery housing further comprises a visible power meter to indicate the amount of charge remaining in the one or more rechargeable batteries.

13. The cordless flat iron device of claim 11 wherein the one or more rechargeable batteries are lithium ion batteries.

14. The cordless flat iron device of claim 11 wherein the battery housing has a length of about five inches and a width of about two and a half inches.

15. The cordless flat iron device of claim 11 further comprising a battery recharging station comprising:

a housing;

a power cord for plugging the recharging station into an electrical outlet;

said housing further comprising a charging slot;

said charging slot comprising a set of electrical contacts that are operably connected to transmit power from the electrical outlet through the power cord;

wherein said charging slot further comprises a slot shaped to receive and secure the battery housing such that when the battery housing is secured in the charging slot, the electrical contacts of the battery housing are in contact with the electrical contacts of the charging slot such that the one or more rechargeable batteries of the battery housing can be recharged.

16. A suite of cordless hair styling implements powered by one or more interchangeable and rechargeable battery packs comprising:

(a) a removable battery pack comprising:

a battery housing containing one or more rechargeable batteries;

said battery housing further comprising an outer face and a set of electric contact points operably connected to the one or more rechargeable batteries;

(b) a cordless hair dryer device comprising:

a hair dryer housing;

an electric fan supported in said hair dryer housing;

an electric heater element supported in said hair dryer housing;

said hair dryer housing further comprising a handle;

said handle further comprising an indentation of substantially the same size as the battery housing, said indentation further comprising electrical contacts operably connected to the electric fan and the electric heater element;

wherein the battery housing may be inserted into the indentation and secured in place, such that when the battery housing is secured in place, outer face of the battery housing generally aligns with the edges and curvature of the indentation to form a curved outer face of the handle, and wherein when the battery housing is secured in place, the electric contact points of the battery housing are electrically connected to the electrical contacts of the indentation, thereby allowing current to flow from the one or more rechargeable batteries to provide power to the electric fan and electric heater element;

(c) a cordless curling iron device comprising:

an elongated curling mandrel;

a heating element operably connected to the curling mandrel;

a handle extending from said curling mandrel;

said handle further comprising an indentation of substantially the same size as the battery housing, said indentation further comprising electrical contacts operably connected to the heating element;

wherein the battery housing may be inserted into the indentation and secured in place, such that when the battery housing is secured in place, the outer face of the battery housing generally aligns with the edges and curvature of the indentation to form a curved outer face of the handle, and wherein when the battery housing is secured in place, the electric contact points of the battery housing are electrically connected to the electrical contacts of the indentation, thereby allowing current to flow from the one or more rechargeable batteries to provide power to the heating element;

(d) a cordless flat iron device comprising:

a first elongated arm;

a second elongated arm comprising a heating element and an indentation of substantially the same size as the battery housing, said indentation further comprising electrical contacts operably connected to the heating element;

wherein said first elongated arm and said second elongated arm are attached at a pivot point;

wherein the battery housing may be inserted into the indentation and secured in place, such that when the battery housing is secured in place, the outer face of the battery housing generally aligns with the edges and curvature of the indentation to form a curved outer face on the second elongated arm, and wherein when the battery housing is secured in place, the electric contact points of the battery housing are electrically connected to the electrical contacts of the indentation, thereby allowing current to flow from the one or more rechargeable batteries to provide power to the heating element;

wherein when the battery housing is secured in place, the electric contact points of the battery housing are electrically connected to the electrical contacts of the indentation, thereby allowing current to flow from the one or more rechargeable batteries to provide power to the first and second heating elements.

17. The suite of cordless hair styling implements of claim 16 further comprising a battery recharging station comprising:

a housing;

a power cord for plugging the recharging station into an electrical outlet;

said housing further comprising a charging slot;

said charging slot comprising a set of electrical contacts that are operably connected to transmit power from the electrical outlet through the power cord;

wherein said charging slot further comprises a slot shaped to receive and secure the battery housing such that when the battery housing is secured in the charging slot, the electrical contacts of the battery housing are in contact with the electrical contacts of the charging slot such that the one or more rechargeable batteries of the battery housing can be recharged.

18. The suite of cordless hair styling implements of claim 16 wherein the one or more rechargeable batteries are lithium ion batteries.

* * * * *